US009745161B2

(12) United States Patent
Dim et al.

(10) Patent No.: US 9,745,161 B2
(45) Date of Patent: Aug. 29, 2017

(54) DEVICE FOR RECEIVING AND SUBMITTING A SUBSTRATE

(75) Inventors: Yuval Dim, Moshav Haniel (IL); Eviatar Halevi, Macabim (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 65 days.

(21) Appl. No.: 14/413,207

(22) PCT Filed: Jul. 12, 2012

(86) PCT No.: PCT/IL2012/050245

§ 371 (c)(1),
(2), (4) Date: Jan. 6, 2015

(87) PCT Pub. No.: WO2014/009940

PCT Pub. Date: Jan. 16, 2014

(65) Prior Publication Data

US 2015/0175371 A1 Jun. 25, 2015

(51) Int. Cl.
*B65H 9/06* (2006.01)
*B65H 9/10* (2006.01)
(Continued)

(52) U.S. Cl.
CPC ..... *B65H 9/06* (2013.01); *B26D 7/20* (2013.01); *B41J 3/28* (2013.01); *B65H 3/0816* (2013.01); *B65H 3/44* (2013.01); *B65H 5/10* (2013.01); *B65H 9/10* (2013.01); *B65H 9/16* (2013.01); *B26D 7/018* (2013.01); *B26F 1/3813* (2013.01); *B65H 2404/54* (2013.01); *B65H 2801/15* (2013.01)

(58) Field of Classification Search
None
See application file for complete search history.

(56) References Cited

U.S. PATENT DOCUMENTS 5,765,984 A * 6/1998 Stefano ..... B21D 43/24 414/222.08
6,296,403 B1 10/2001 Duchovne
(Continued)

FOREIGN PATENT DOCUMENTS

DE 102008031179 A1 1/2009
EP 1717030 A2 11/2006
(Continued)

OTHER PUBLICATIONS

Hewlett-Packard Development Company, L.P., HP Scitex FB6700 Printer, Nov. 2009. http://h10010.www1.hp.com/wwpc/pscmisc/vac/us/product_pdfs/3337942.pdf.
(Continued)

*Primary Examiner* — Lisha Jiang
(74) *Attorney, Agent, or Firm* — HP Inc. Patent Department

(57) ABSTRACT

A device, method and system for receiving and submitting a substrate, the device including an XY table, the XY table having one or a plurality of sides for accepting a substrate, a set of manipulators coupled to the XY table, the manipulators configured to accept and register the substrate from the one or plurality of sides of the XY table, and a set of retractable dividers on the XY table configurable to register one or a plurality of substrates concurrently.

10 Claims, 11 Drawing Sheets

(51) Int. Cl.

| | |
|---|---|
| ***B65H 9/16*** | (2006.01) |
| ***B65H 3/44*** | (2006.01) |
| ***B65H 3/08*** | (2006.01) |
| ***B65H 5/10*** | (2006.01) |
| ***B41J 3/28*** | (2006.01) |
| ***B26D 7/20*** | (2006.01) |
| *B26D 7/01* | (2006.01) |
| *B26F 1/38* | (2006.01) |

(56) References Cited

U.S. PATENT DOCUMENTS

| | | | | |
|---|---|---|---|---|
| 6,542,263 | B2 | 4/2003 | Emmenegger et al. | |
| 6,697,694 | B2 * | 2/2004 | Mogensen | H05K 3/125 264/239 |
| 7,722,032 | B2 | 5/2010 | Sasaki et al. | |
| 2002/0132564 | A1 * | 9/2002 | Valek | B24B 7/17 451/41 |
| 2010/0258016 | A1 | 10/2010 | Naivelt et al. | |
| 2010/0309492 | A1 | 12/2010 | Baxter | |
| 2011/0041717 | A1 | 2/2011 | Takahashi et al. | |

FOREIGN PATENT DOCUMENTS

| | | | | |
|---|---|---|---|---|
| WO | WO 2004/082956 | A2 * | 9/2004 | |
| WO | WO 2004082956 | A2 * | 9/2004 | B41C 1/1066 |

OTHER PUBLICATIONS

International Search Report and Written Opinion dated Apr. 15, 2013, issued on PCT Patent Application No. PCT/IL2012/050245 dated Jul. 12, 2012, European Patent Office.

* cited by examiner

DEVICE FOR RECEIVING AND SUBMITTING A SUBSTRATE

CLAIM FOR PRIORITY

The present application is a national stage filing under 35 U.S.C 371 of PCT application number PCT/IL2012/050245, having an international filing date of Jul. 12, 2012, the disclosure of which is hereby incorporated by reference in its entirety.

BACKGROUND

XY tables may be used as a positioning table in semiconductor assembling equipment, machine tools, measurement equipment, printing and other uses. In some instances XY tables may be substrate loading tables. Substrate loading tables may be used in many industries including printing and silicon wafer printing. Substrate loading tables may use rollers. Rollers typically provide for low friction interaction with the substrate to be acted upon and help automate a process by moving, positioning and stopping the substrate as necessary along a production line. The rollers may be designed to accommodate many different types of substrates, typically the system may be designed for a substrate with a particular set of properties. Properties of a substrate may include varying in width, length, thickness, area, density and chemical composition.

Flat bed inkjet printers print on both rigid and flexible substrates. These printers may have a large bed onto which the substrate may be placed. The substrate may be placed in a certain orientation, typically matching bed/printhead movement directions. Because of differences in properties of the flexible and rigid substrates, two different automatic loading systems may be used.

BRIEF DESCRIPTION OF THE DRAWINGS

Examples are described in the following detailed description and illustrated in the accompanying drawings in which.

Figure 1:
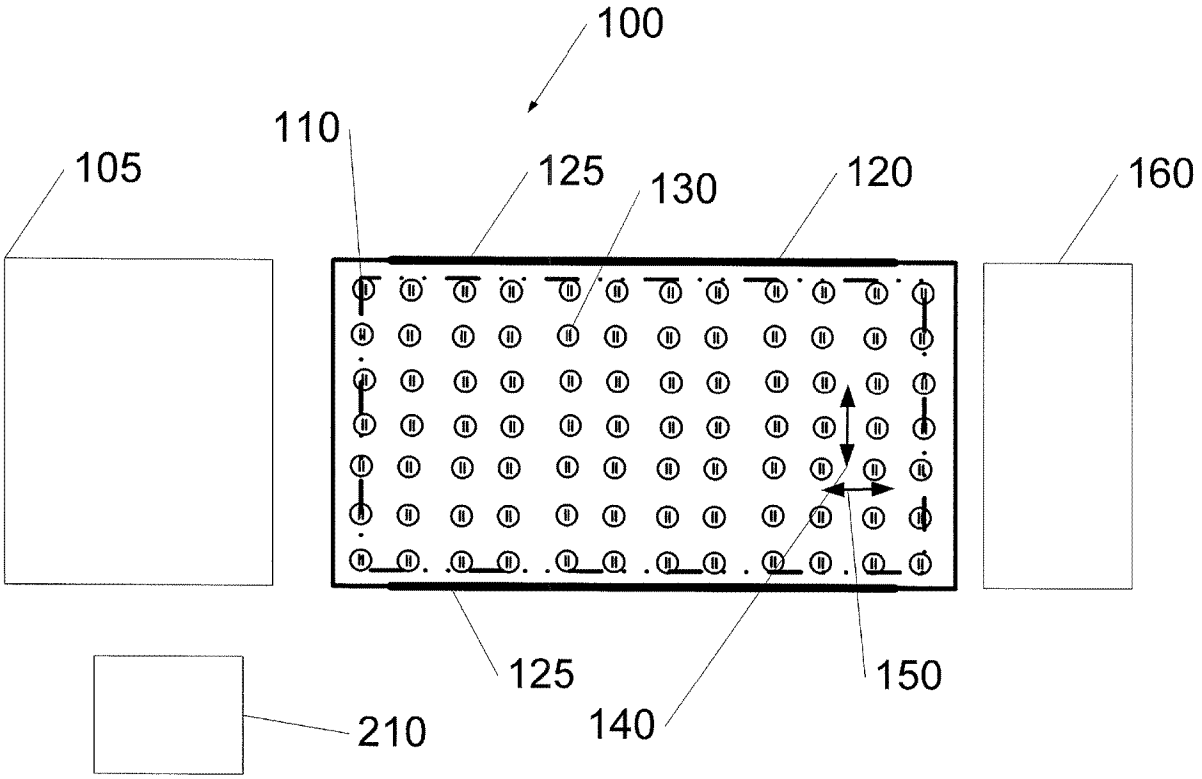
FIG. 1 is a schematic illustration of XY table within a system, according to an example.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the methods and apparatus. However, it will be understood by those skilled in the art that the present methods and apparatus may be practiced without these specific details. In other instances, well-known methods, procedures, and components have not been described in detail so as not to obscure the present methods and apparatus.

Although the examples disclosed and discussed herein are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence. Additionally, some of the described method examples or elements thereof can occur or be performed at the same point in time.

Unless specifically stated otherwise, as apparent from the following discussions, it is appreciated that throughout the specification, discussions utilizing terms such as "adding", "associating" "selecting," "evaluating," "processing," "computing," "calculating," "determining," "designating," "allocating" or the like, refer to the actions and/or processes of a computer, computer processor or computing system, or similar electronic computing device, that manipulate, execute and/or transform data represented as physical, such as electronic, quantities within the computing system's registers and/or memories into other data similarly represented as physical quantities within the computing system's memories, registers or other such information storage, transmission or display devices.

FIG. 1 is a schematic illustration of an XY table within a system according to an example.

A system 100, in some examples, a printing system, may include a configurability to take one or a plurality of substrates 110 from one or a plurality of distinct substrate sources 105, e.g., a stack of substrates on a table, pallet or other source. In some examples, substrate 110 may be on a roll of substrate 110 that may be manually or automatically cut before reaching the next step in a process, e.g., a printer.

Substrate 110 may be rigid, flexible, thick, thin, have varying areas and shape, or have other characteristics. Substrate 110 may be paper or another material. Substrate 110 may be configured to be printed on.

An XY table 120 may allow movement of substrate 110 in two mutually orthogonal directions. In some examples, an XY table may allow the substrate to move along the surface of the XY table. XY table 120 may provide for the movement of substrate 110. In some examples, the substrate may be placed in an arbitrary orientation on XY table 120, and become registered, e.g., properly aligned for a next step, for example, properly aligned for printing, by the components of XY table 120, by use of one or a plurality of rollers 130. Other devices such as balls, cylinders, bearings, air vents, vacuum vents, or other substrate manipulators coupled to XY table 120 may also be used in addition to or instead of rollers 130, when they allow for the movement of a substrate on XY table 120. In some examples substrate 110 may move along XY table 110 via a combination of rollers 130 and other substrate manipulators.

In some examples, rollers 130 may be capable of rotating on at least two axes, in a single or in both directions along the axis, the axis may be depicted by arrows 140 and 150. In some examples rollers 130 may rotate on only one axis in either direction along that axis. In some examples, rollers 130 may be configured to rotate independently of a neighboring roller. In some examples, groups of rollers may move concurrently. Rollers 130 may be configured to move substrate 110 in the general direction of a component of system 100, e.g., a printer 160 or a component thereof, e.g., a printer drum. One or a plurality of rollers 130 may move substrate 110 to another component within system 100. In some examples, one or a plurality of rollers 130 may move substrate 110 to a component outside of system 100.

In some examples, substrate 110 may be moved from substrate source 105 to XY table 120- In some examples, additional rollers and or manipulators may be placed on edges of XY table 120 to facilitate a transfer of substrates 110 to XY table 120 as described below with reference to FIG. 8*a* and FIG. 8*b*. Rollers on XY table 120, in some examples, controlled by control unit 210, may move, align and register substrate 110 on XY table 120 such that substrate 110 is prepared to be transferred off of XY table 120. Stoppers 125 and/or corner pieces on XY table 120 may facilitate the moving, aligning and registering of substrate 110. Stoppers 125 are depicted on an edge of XY table 120 for illustrative purposes, stoppers 125 may be placed in multiple locations on XY table 120. Stoppers 125 may be retractable. There may be one or multiple stoppers 125, the multiple stoppers 125 may form a line along an axis, the axis parallel to an edge of XY table 120.

In some examples, once substrate 110 is registered, substrate 110 may be mounted on a component of a printer 160, e.g., a printer drum. Rollers 130 and/or other manipulators may facilitate the automatic loading of a registered substrate onto the printer drum. Printer 160 or a component thereof is drawn on the figure in a location for illustrative purposes only. Printer 160 may be placed at other locations relative to and adjacent to XY table 120.

Figure 2:
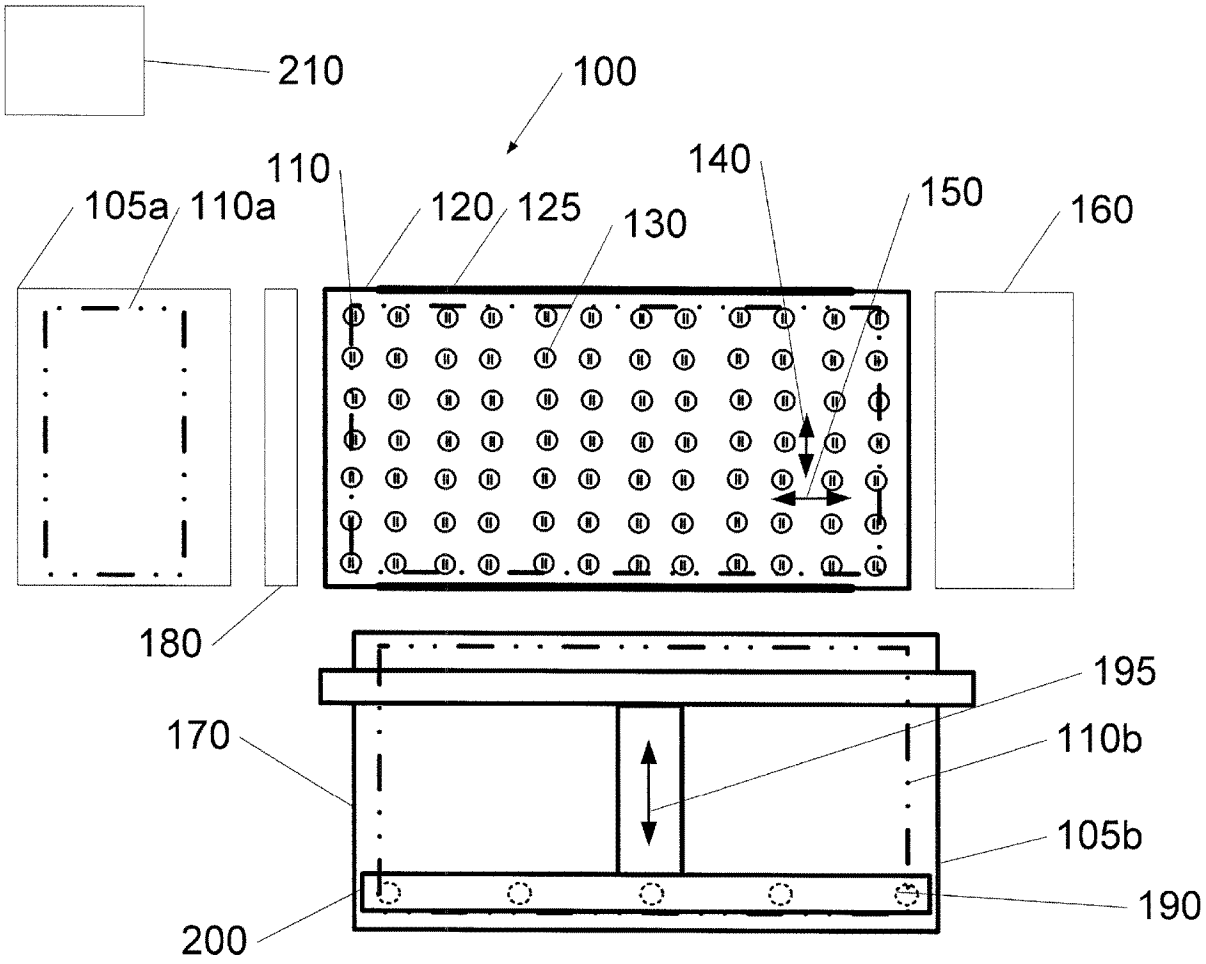
FIG. 2 is a schematic illustration of a XY table, according to an example.

FIG. 2 is a schematic illustration of an XY table, according to an example.

In system 100 there may be one or a plurality of substrate sources 105, including substrate source 105 which may include substrate sources 105*a* and/or substrate source 105*b*. There may be of one or a plurality of substrate 110, which may include substrate 110*a* and substrate 110*b*, respectively with substrate sources: in some examples, substrate 110*a* may be stored on a first substrate source 105*a* and substrate 110*b* may be stored on a second substrate source 105*b*. The number of substrate sources 105 are depicted for illustrative purposes only, a third substrate source 105, or plurality of further substrate sources 105, may also be included in system 100. The location of substrate sources 105 are depicted for illustrative purposes only, substrate sources may be located in varied locations around XY table 120.

First substrate source 105*a* may be a roll of substrate 110*a*. In some examples, substrate 110*a* may be manually or automatically cut off of substrate source 105*a* by a cutter 180, and fed onto XY table 120. Cutter 180 may cut along one or a plurality of axes. Cutter 180 may be in communication with control unit 210. In some examples, second substrate source 105*b* may be a stack of precut substrates 110*b* on a table 170. Table 170 may have an auto-loading device 200 which may include one or a plurality of vacuum sources 190, auto-loading device 200 configured, in some examples, to move in the direction as indicated by arrow 195, with reference to table 170 and lift substrate 110*b*. Auto-loading device 200 may transfer substrate 110*b* to XY table 120. Auto-loading device 200 may be coupled to table 170 or coupled to XY table 120, or may be coupled to both and or additional components of the system. Auto-loading device 200 may remain in an idle state over XY table 120, or over table 170. Auto-loading device may transfer substrates 110 to various locations on XY table 120.

Auto-loading device 200 may pick up one or a plurality of substrates 110*b* from substrate source 105*b* and place substrate 110*b* on XY table 120 in a directed or arbitrary fashion. Auto-loading device may be in communication with control unit 210.

XY table 120 may allow movement of substrate 110*a* and/or 110*b* in two mutually orthogonal directions- XY table 120 may provide for the movement of substrate 110*a* and/or 110*b* by use of rollers 130. Other devices such as balls or other elements coupled to XY table 120 may also be used when they allow for the movement of substrate 110*a* and/or 110*b* on XY table 120. A combination of rollers 130, cylinders or other manipulators may also be used, as described above with reference to FIG. 1.

In some examples, rollers 130 may be configured to rotate on at least two axes, in two directions for each axis. The directions typically employed toward printer 160 or another component within a flow, and may be depicted by arrows 140 and 150. In some examples, rollers 130 may be configured to rotate in additional directions- Rollers 130 may be configured to move substrate 110*a* and/or 110*b* in the general direction of a printer 160 or a component thereof, e.g., a printer drum. Rollers 130 may move substrate 110*a* and/or 110*b* to another component within system 100. In some examples, rollers 130 may move substrate 110*a* and/or 110*b* to a component outside of system 100.

Rollers on XY table 120, in some examples, controlled by control unit 210, may move, align and register substrate 110*a* and/or 110*b* on XY table 120 such that substrate 110*a* and/or 110*b* is prepared to be transferred off of XY table 120. Stoppers 125 and/or corner pieces on XY table 120 may facilitate the moving, aligning and registering of substrate 110*a* and/or 110*b*.

In some examples, once substrate 110*a* and/or 110*b* is registered, substrate 110*a* and/or 110*b* may be mounted on a component of a printer 160, e.g., printer drum. Rollers 130 may facilitate the automatic loading and/or mounting of a registered substrate onto the printer drum. In some examples, other components of system 100, or other devices may transfers, or facilitate the transfer of substrates 110*a* and/or substrates 110*b* to printer 160.

System 100, as depicted in FIG. 2 may be configurable such that substrate sources 105*a* and 105*b* may be swappable, and or exchangeable or their locations swapped, exchanged or moved. Substrate sources 105*a* and 105*b* may be swappable, and or exchangeable in real time with limited printer or system downtime- In some examples, system 100 may be configured to switch from taking substrate 110 from source 105*a* or from 105*b* or from another source automatically. In some examples, system 100 may be configured to switch from taking substrate 110 from source 105*a*, or from 105*b*, or from another source without having to shut down system 100.

Figure 3:
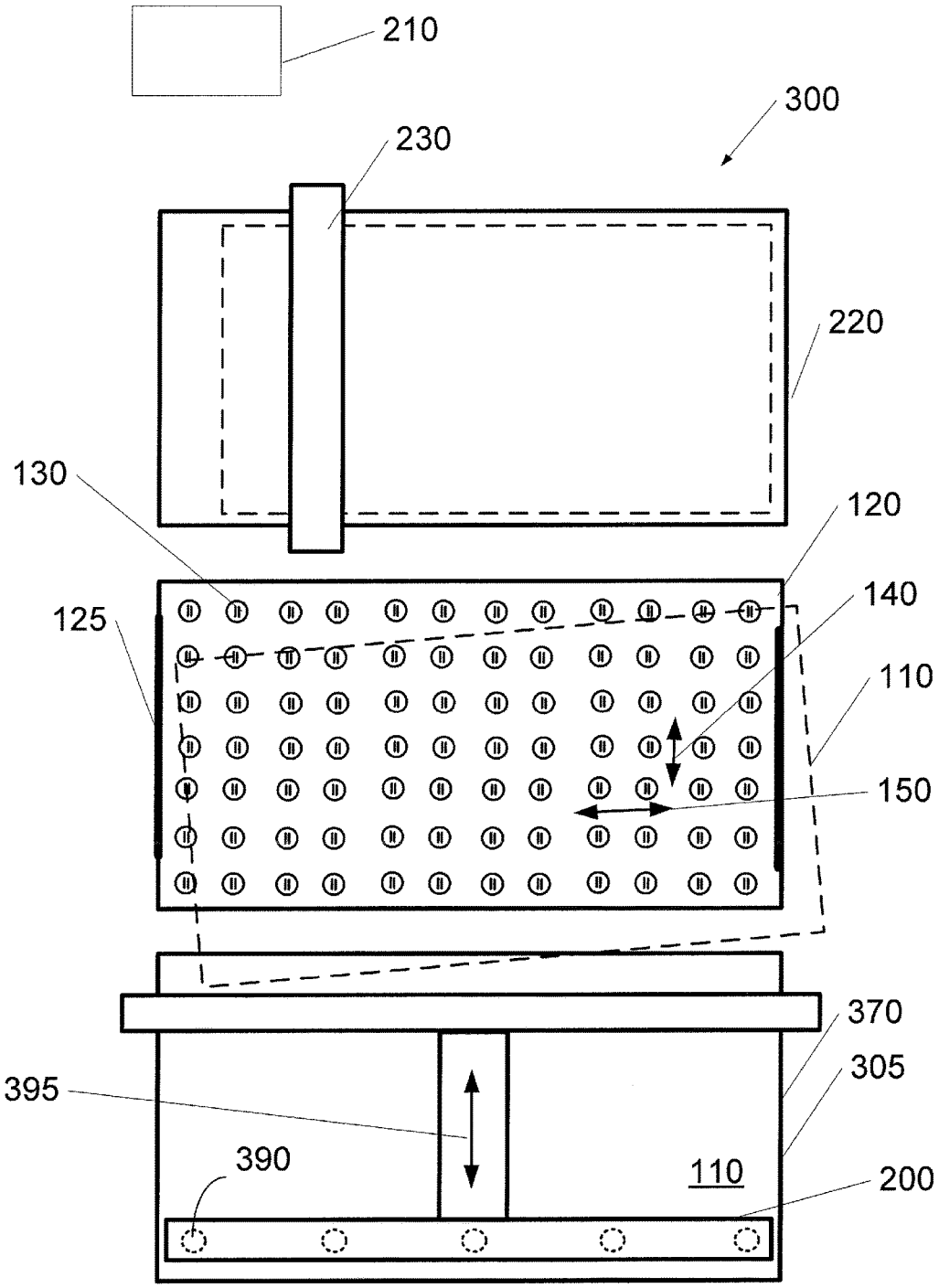
FIG. 3 is a schematic illustration of a flat bed printer based system for automatically loading and registering a substrate, according to an example.

FIG. 3 is a schematic illustration of a flat bed printer based system 300 for automatically loading and registering a substrate.

In some examples, a substrate source 305 may be a stack of precut substrates 110 on a table 370- Other substrates 110 may also be used, substrates 110 described above. Table 370 may have an auto-loading device 200, similar or the same as described above with reference to FIGS. 1 and 2, which may include one or a plurality of vacuum sources 390, auto-loading device 200 may transfer substrate 110 to XY table 120.

Auto-loading device 200 may pick up one or a plurality of substrates 110 from substrate source 305 and place substrate 110 on XY table 120 in a directed or arbitrary fashion. Auto-loading device may be in communication with control unit 210.

XY table 120 may allow movement of substrate 110 in two mutually orthogonal axes, as described above. XY table 120 may provide for the movement of substrate 110 by use of one or a plurality of rollers 130, as described above. Other devices such as balls or other elements coupled to XY table 120 may also be used when they allow for the movement of substrate 110 on XY table 120, as described above.

In some examples, rollers 130 may be configured to rotate in at least two directions, the directions depicted by arrows 140 and 150. In some examples, rollers 130 may be configured to rotate in additional directions. Rollers 130 may be configured to move substrate 110 in the general direction of a printer 220. Printer 220 may be a flat bed printer. Rollers 130 may move substrate 110 to another component within system 300. In some examples, rollers 130 may move substrate 110 to a component outside of system 300, as described above with reference to FIG. 1.

Rollers on XY table 120, in some examples, controlled by control unit 210, may move, align and/or register substrate 110 on XY table 120 such that substrate 110 is prepared to be transferred off of XY table 120. Stoppers 125 and/or corner pieces on XY table 120 may facilitate the moving, aligning and registering of substrate 110. The stoppers 125, as described above with reference to FIGS. 1 and 2.

In some examples, once substrate 110 is registered, substrate 110 may be moved to printer 120. Rollers 130 may facilitate the automatic loading of a registered substrate onto printer 220- Other methods may be used to transfer substrate to printer 220, as described below with reference to FIG. 8*a* and FIG. 8*b*. Printer 220 may have a device 230 that moves across a surface of substrate 110 to print on the surface- Substrate 110 may be modified by printer 220 such that it becomes printed on. In some examples printer 220 may include a table. The table may include vacuum ports for maintaining the position of substrate 110. The table may move, carrying substrates 110 into a printer area to be printed upon.

Figure 4:
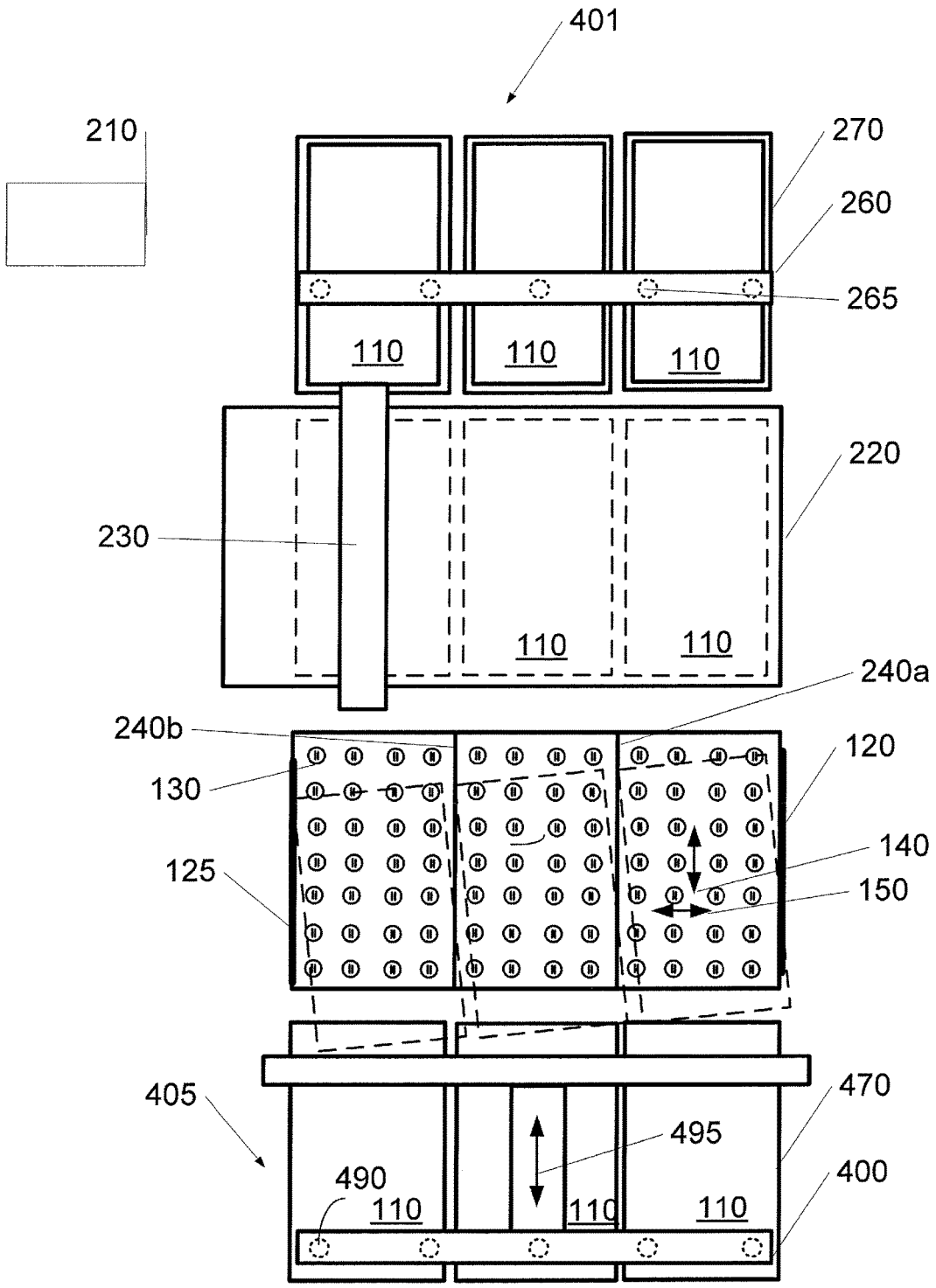
FIG. 4 is a schematic illustration of a system for registering a plurality of substrates and transferring the registered substrates to a printer, according to an example.

FIG. 4 is a schematic illustration of a system for registering a plurality of substrates concurrently or nearly concurrently and transferring the registered substrates concurrently or nearly concurrently to a printer.

In some examples, a system 401 may be configured to move one or a plurality of substrates 110 through a printing cycle. In some examples, system 401 may be configured to move substrate 110 through a workflow. Substrate source 405 may include one or a plurality of substrates 110, the one or a plurality of substrates may be stacked into one or a plurality of separate piles on table 470, the substrates 110 as described above with reference to FIGS. 1 and 2. FIG. 4 depicts three separate piles of substrate 110 on table 470 for illustrative purposes only. There may be a greater number of piles on table 470 of substrate 110. There may be a smaller number of piles of substrate 110. The piles may include different substrates 110. The substrates 110 may differ in one or a plurality of characteristics including size, shape, color texture, rigidity, flexibility or other characteristics- Piles of substrate 110 may all reside on a single table 470 or on multiple tables 470. Table 470 may have barriers to separate the piles of substrate 110.

Substrates 110 may be placed arbitrarily on XY table 120. Table 470 may have an auto-loading device 400, similar to auto-loading device 200 described above, which may include one or a plurality of vacuum sources 490. In some examples, auto-loading device 400 may move in the direction of arrow 495, and lift, move, manipulate or otherwise facilitate the changing of position and/or location of substrate 110, e.g., moving substrate to XY table 120. Table 470 may have one or a plurality of auto-loading devices 400, the auto-loading devices may facilitate the transfer of substrates 110 to XY table 120 concurrently or not concurrently.

Auto-loading device 400 may pick up one or a plurality of substrates 110 from substrate source 105 and place substrate 110 on XY table 120 in a directed or arbitrary fashion. Auto-loading device may be in communication with control unit 210.

Other methods of transferring substrates 110, as described below with reference to FIGS. 8*a* and 8*b* may also be used.

In some examples, XY table 120 may have dividers 240*a* and 240*b* configured to facilitate the registration of one or a plurality of substrates 110 on XY table 120. In some examples, dividers 240*a* and 240*b* may include a set of smaller dividers, the smaller dividers having the combined length of dividers 240*a* and 240*b* depicted in the figure. In some examples, XY table may have a greater number of dividers. In some examples, XY table 120 may have fewer dividers. Rollers 130, or a combination of rollers 130 and other manipulators, may be configured to push and/or direct substrates 110 in directions depicted by arrows 140 and 150 until substrates 110 are registered or nearly registered. In some examples, it may take a longer amount of time for one substrate 110 to be registered than a second substrate 110 after being placed concurrently or nearly concurrently on XY table 120.

One or a plurality of sides 125 and/or corner pieces of XY table 120 may be configured to facilitate the registration of substrates 110. Sides 125, and the registration of substrates 110 may be as described above with reference to FIG. 1.

Registered substrates 110 may be moved concurrently, nearly concurrently or not concurrently to printer 220. An auto-loading device may pick up one or a plurality of substrates 110 from XY table 120 and place one or a plurality of substrates 110 on printer 220. Auto-loading device may be in communication with control unit 210. Substrate 110 may move from XY table 120 to printer 220 by other means. In some examples, rollers 130 may be configured to facilitate the transfer of one or a plurality of substrates 110 from XY table 120 to printer 220- In some examples substrates 110 may be transferred to printer 220 by methods described below with reference to FIG. 8*a* and FIG. 8*b*. In some examples, registered substrates 110 may be moved to another component of system 401. In some examples, registered substrates 110 may be moved to a component not in system 401.

Printer 220 may have a device 230 that moves across a surface of substrate 110 to print. This may result in a modified substrate 110, e.g., a printed substrate 110. In some examples, substrates 110 may be placed on a table, as described above with reference to FIG. 3, that table then moved into an area where substrates 110 are modified, e.g., they are printed upon.

An auto-offloading device 260 may pick up one or a plurality of substrates 110 from printer 220 and place one or a plurality of substrates 110 on to one or a plurality of tables 270. In some examples, substrates 110 may be placed or packed in boxes cartons or other containers for shipping, storage or other purposes. Auto-offloading device 260 which may include one or a plurality of vacuum sources 265, the auto-offloading device 260 may be configured, in some examples, to move with reference to one or a plurality of tables 270 and printer 220 and lift one or a plurality of substrates 110. Substrates 110 may be lifted off printer 220 by auto-offloading device 260 either concurrently, nearly concurrently, or not concurrently. In some examples, auto-offloading device 260 may be able to move in both an X and a Y direction and may be configured to stack substrates 110 in a number of methodologies, including collating.

Auto-offloading device 260 may be in communication with control unit 210. Table 270 may be configured for collating and or collecting printed, e.g., modified, substrates 110.

Figure 5:
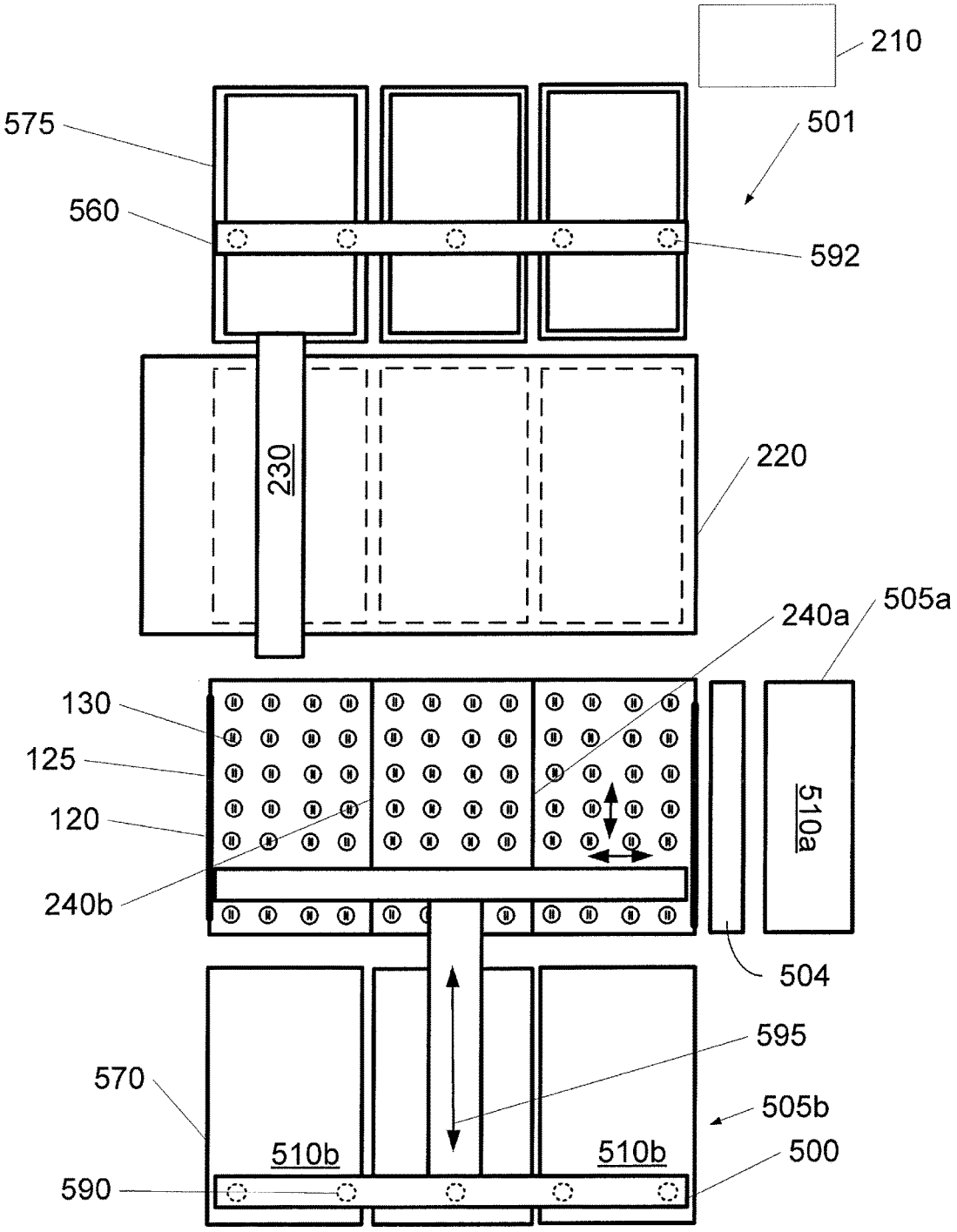
FIG. 5 is an example of a system for using one or a plurality of different substrate sources, according to an example.

FIG. 5 is an example of a system for using one or a plurality of different substrate sources.

In some examples, there may be one or plurality substrates 510 and one or a plurality of substrate sources 505 in a system 501. Substrates 510 may include one or a plurality of substrate 510*a*, one or a plurality of substrate 510*b*, and/or other substrates. Substrate sources 505 may include but are not limited to one or a plurality of substrate source 505*a* which may include substrate 510*a* on a roller. A second substrate source 505*b* may include one or a plurality of substrates 510*b*, the one or a plurality of substrates may be stacked into one or a plurality of separate piles on table 570. The location of substrate sources 505 are for illustrative purposes only, substrate sources 505 may be placed in additional locations within the system, as described above.

FIG. 5 depicts three separate piles of substrate 510*b* on table 570 for illustrative purposes only. There may be a greater number of piles on table 570 of substrate 510*b*. There may be a smaller number of piles of substrate 510*b*. The piles may include different substrates 510*b*. The substrates 510*a* and 510*b* may differ in one or a plurality of characteristics including size, shape, color texture, rigidity, flexibility or other characteristics- Piles of substrate 510*b* may all reside on a single table 570 or on multiple tables 570. Table 570 may have barriers to separate the piles of substrate 510*b*.

Table 570 may have an auto-loading device 500 which may include one or a plurality of vacuum sources 590, auto-loading device 500 configured, in some examples, to move with reference to table 570, in direction depicted by arrow 595, and lift, move, manipulate or facilitate the transfer of one or a plurality of substrates 510*b*.

Auto-loading device may be similar to auto-loading device 200 described above. Vacuum sources 590 may transfer one or a plurality of substrates 510*b* to XY table 120. Table 570 may have one or a plurality of auto-loading devices 500, the auto-loading devices may transfer one or a plurality of substrates 510*b* to XY table 120, concurrently, nearly concurrently, or not concurrently.

Auto-loading device 500 may pick up one or a plurality of substrates 510*b* from substrate source 505*b* and place substrate 110 on XY table 120 in a directed or arbitrary fashion. Auto-loading device may be in communication with control unit 210.

In some examples, substrate 510*b* may be moved to XY table 120 as described below with reference to FIG. 8*a* and FIG. 8*b*.

Substrates 510*a* from substrate source 505*a* may also be moved to XY table 120. In some examples, substrate 510*a* may be cut off of a roll where the roll is substrate source 505*a* by an automatic cutting unit 504. In some examples, substrate 510*a* may be cut off of a roll where the roll is substrate source 505*a* by a manual cutting unit. Cutting of substrate 510*a* may be along one or a plurality of axes- In some examples, substrate source 505*a* may also be a pile or a pallet of substrates 510*a*. In some examples, substrate 510*a* may be moved to XY table 120 as described below with reference to FIG. 8*a* and FIG. 8*b*.

XY table 120 may have dividers 240*a* and 240*b* configured to register or facilitate the registration of one or a plurality of substrates 510*a* and/or 510*b* on XY table 120. In some examples, XY table may have a greater number of dividers. In some examples, XY table 120 may have fewer dividers. In some examples the dividers may be retractable. In some examples, the dividers may be fixed. Rollers 130 and/or other manipulators, as described above, may be configured to move substrates 510*a* and/or 510*b* in directions depicted by arrows 140 and 150 until substrates 510*a* and/or 510*b* are registered. In some examples, it may take a longer amount of time for one of the substrates 510*a* and/or 510*b* to be registered than a second substrates 510*a* and/or 510*b* after being placed concurrently, nearly concurrently, or not concurrently on XY table 120.

One or a plurality of sides 125 and/or corner pieces, as described above, of XY table 120 may be configured to facilitate the registration of substrates 510*a* and/or 510*b*. Sides 125 may be retractable or may be non-retractable.

Registered substrates 510*a* and/or 510*b* may be moved concurrently, nearly concurrently, or not concurrently to printer 220, the printer and one of the possible printer mechanisms described above- In some examples, rollers 130 may be configured to facilitate the transfer of one or a plurality of substrates 510 from XY table 120 to printer 220. In some examples, registered substrates 510*a* and/or 510*b* may be moved to another component of a system 501. In some examples, registered substrates 510*a* and/or 510*b* may be moved to a component not in system 501-

An Auto-loading device may pick up one or a plurality of substrates 510*a* and/or 510*b* from XY table 120 and place one or a plurality of substrates 510*a* and/or 510*b* on printer 220. Auto-loading device may be in communication with control unit 210. In some examples, substrate 510*a* and/ substrate 510*b* may move from XY table 120 to printer 220 via rollers 130. In some examples, substrate 510*a* and/or substrate 510*b* may be moved to XY table 120 as described below with reference to FIG. 8*a* and FIG. 8*b*.

Printer 220 may have a device 230 that moves across a surface of substrates 510*a* and/or 510*b* to print on the substrates, the resulting printed on substrates may be modified.

Auto-offloading device 560 may pick up one or a plurality of substrates 510*a* and/or 510*b* from printer 220 and place one or a plurality of substrates 510*a* and/or 510*b* on table 575. Auto-offloading device 560 which may include one or a plurality of vacuum sources 590, auto-offloading device 560 configured, in some examples, to move with reference to table 575 and printer 220 and lift one or a plurality of substrates 510*a* and/or 510*b*. Substrates 510*a* and/or 510*b* may be lifted off printer 220 by auto-offloading device 560 either concurrently or not concurrently. In some examples, auto-offloading device 560 may be able to move in both an X and a Y direction and may be configured to stack substrates 510*a* and/or 510*b* in a number of methodologies, including collating.

Auto-offloading device 560 may be in communication with control unit 210. Table 575 may be configured for collating and or collecting printed substrates 510*a* and/or 510*b*.

Figure 6:
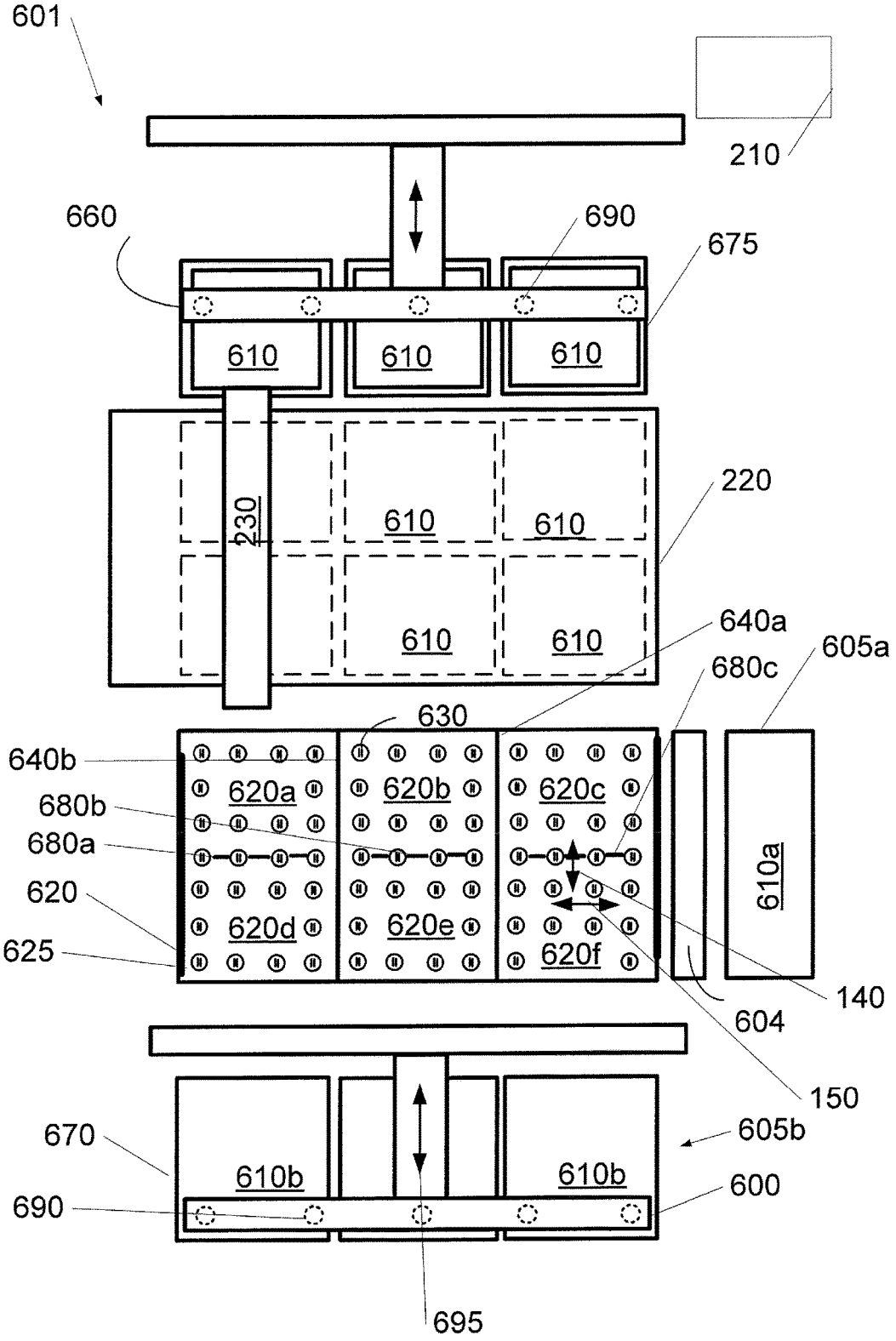
FIG. 6 is an example of a system using two different substrate sources, according to an example.

FIG. 6 is an example of a system using two different substrate sources.

In some examples, there may be one or a plurality of substrates 610 including but not limited to substrates 610*a*, substrates 610*b* and/or other substrates. In some examples, there may be one or a plurality of substrate sources 605 including but not limited to substrate source 605*a* which may include substrate 610*a* on a roller. A second substrate source 605*b* may include one or a plurality of substrates 610*b*, the one or a plurality of substrates may be stacked into one or a plurality of separate piles on table 670. Other substrate sources 605 may also be used.

System 601 may be a system for printing on substrates 610. System 601 may be a system for a workflow or other use of substrates 610. FIG. 6 depicts three separate piles of substrate 610*b* on table 670 for illustrative purposes only; there may be a greater number of piles on table 670 of substrate 610*b*. There may be a smaller number of piles of substrate 610*b*. The piles may include different substrates 610*b*. The substrates 610*a* and 610*b* may differ in one or a plurality of characteristics including size, shape, color texture, rigidity, flexibility or other characteristics- Piles of substrate 610*b* may all reside on a single table 670 or on multiple tables 670. Table 670 may have barriers and/or dividers to separate the piles of substrate 610*b*.

Table 670 may have an auto-loading device 600, auto-loading device may be similar to auto-loading device 200 described above. Auto-loading device 600 may include one or a plurality of vacuum sources 690, and may be configured, in some examples, to move with reference to table 670 and lift one or a plurality of substrates 610*b*. Vacuum sources 690 may transfer one or a plurality of substrates 610*b* to XY table 620. Table 670 may have one or a plurality of auto-loading devices 600, the auto-loading devices may transfer one or a plurality of substrates 610*b* to XY table 620, in some examples, in the direction of arrow 695, the substrates being transferred concurrently, nearly concurrently, or not concurrently.

Auto-loading device 600 may pick up one or a plurality of substrates 610*b* from substrate source 605*b* and place substrate 610 on XY table 620 in a directed or arbitrary fashion. Auto-loading device may be in communication with control unit 210. In some examples, substrate 610*b* may be moved to XY table 120 as described below with reference to FIG. 8*a* and FIG. 8*b*. Substrates 610*a* from substrate source 605*a* may also be moved to XY table 620. In some examples, substrate 610*a* may be cut off of a roll where the roll is substrate source 605*a* by an automatic cutting unit 604. In some examples, substrate 610*a* may be cut off of a roll where the roll is substrate source 605*a* by a manual cutting unit. In some examples, substrate 610*a* may be unwound from the roll at a length, and cut to a length and a width by an in-line cutter- Automatic cutting unit may be configured to cut substrate 610*a* in a first and/or second axis. In some examples, substrate 610*a* may be moved to XY table 120 as described below with reference to FIG. 8*a* and FIG. 8*b*.

XY table 620 may have retractable dividers 640*a* and 640*b* configured to register one or a plurality of substrates 610*a* and/or 610*b* on XY table 620. In some examples, XY table may have a greater number of dividers. In some examples, XY table 620 may have fewer dividers. XY table 620 may have retractable dividers 680*a*, 680*b* and 680*c*.

In some examples, when all the dividers are unretracted, XY table 620 may be divided into at least 6 sections: 620*a*, 620*b*, 620*c*, 620*d*, 620*e*, and 620*f*, the sections configured to register or facilitate the registration of substrates 610. In some examples, two or a plurality of sections 620*a-f* can be combined such that adjacent sections may be combined to make larger sections. In some examples, XY table 620 may be divided into a greater number of sections. In some examples, XY table 620 may be divided into a lesser number of sections.

Each section 620*a-f* may provide an area where one or a plurality of substrates 610*a* and/or 610*b* may be registered. In some examples, one or a plurality of substrates 610*b* from source 605*b* may be moved onto XY table 620. In some examples, when substrates 610*b* are moved onto XY table 620 dividers 680*a*, 680*b* and 680*c* are retracted. One or a plurality of substrates 610*b* move along XY table 620 in the directions indicated by arrows 140 and 150 until they reach sections 620*a*, 620*b* and 620*c* respectively of XY table 620. Once one or a plurality of substrates 610*b* reach the above mentioned sections, dividers 680*a*, 680*b* and 680*c* may become unretracted. Once dividers 680*a*, 680*b* and 680*c* are unretracted one or a plurality of additional substrates 610*b* may be moved onto XY table 610, the one or a plurality of additional substrates 610*b* may move into sections 620*d*, 620*e*, and 620*f* respectively. The movement of substrates 610*b*, and the registration of substrates 610*b* may be facilitated by rollers 630. One or a plurality of sides 625 and/or corner pieces of XY table 620 may be configured to facilitate the registration of substrates 610*a* and/or 610*b*. One or a plurality of sides 625 and/or corner pieces of XY table 620 may be retractable. Sides 625 may be similar to sides 125 described above.

The one or a plurality of substrates in sections 620*a-f* may be registered, the registration facilitated by dividers 640*a* and 640*b* and dividers 680*a*, 680*b* and 680*c*. In some examples, some sections 620*a-f* of XY table 620 may not be filled with substrate 610.

In some examples, only substrates 610*b* from substrate source 605*b* may be moved onto XY table 620. In some examples, only substrates from 610*a* from substrate source 605*a* may be moved onto XY table 620. In some examples, some sections of XY table 620 may be filled with substrates 610*a* and other sections of XY table 620 may be filled with substrates 610*b*.

When only substrates from 610*a* from substrate source 605*a* may be moved onto XY table 620 dividers 640*a* and 640*b* and dividers 680*a*, 680*b* and 680*c* may be retracted. Rollers may roll substrates into one or a plurality of sections 620*a-f*. Once one or a plurality of substrates 610*a* are in a desired section of sections 620*a-f*, one or a plurality of dividers 640*a* and 640*b* and dividers 680*a*, 680*b* and 680*c* may become unretracted. When one or a plurality of dividers 640*a* and 640*b* and dividers 680*a*, 680*b* and 680*c* may become unretracted, it may facilitate the movement of additional substrates 610*a* and may facilitate the registration of one or a plurality of substrates 610*a* to be registered in one or a plurality of sections 620*a-f*.

In some examples, one or a plurality of substrates 610*a* and one or a plurality of substrates 610*b* may be moved to XY table 620, to be registered concurrently or nearly concurrently. Dividers 640*a* and 640*b* and dividers 680*a*, 680*b* and 680*c* may need to be retracted and unretracted to accommodate the movement and registration of substrates 610*a* and 610*b*.

Rollers 630 and/or other manipulators may be configured to push substrates 610*a* and/or 610*b* in directions depicted by arrows 140 and 150 until substrates 610*a* and/or 610*b* are registered. In some examples, other means may be used to push substrates 610*a* and/or 610*b* in directions depicted by arrows 140 and 150 until substrates 610*a* and/or 610*b* are registered. In some examples, it may take a longer amount of time for one or a plurality of substrates 610*a* and/or 610*b* to be registered than another one or a plurality of second substrates 610*a* and/or 610*b* after being placed concurrently on XY table 620.

Once one or a plurality of substrates 610*a* are registered in one or a plurality of sections 620*a-f*, the one or a plurality of substrates 610*a* may be transferred to printer 620 as described above. In some examples, one or a plurality of dividers 640*a* and 640*b* and dividers 680*a*, 680*b* and 680*c* may need to be retracted before one or a plurality of substrates 610*a* may be transferred to printer 620, in some examples by rollers 630. In some examples, substrate 610*a* may be moved to printer 620 as described below with reference to FIG. 8*a* and FIG. 8*b*. In some examples, substrate 610*a* and/substrate 610*b* may move from XY table 620 to printer 220 via rollers 630.

Registered substrates 610*a* and/or 610*b* may be moved concurrently or not concurrently to printer 220. In some examples, rollers 630 may be configured to facilitate the transfer of one or a plurality of substrates 610 from XY table 620 to printer 220. In some examples, registered substrates 610*a* and/or 610*b* may be moved to another component of system 601. In some examples, registered substrates 610*a* and/or 610*b* may be moved to a component not in system 601.

In some examples, printer 220 may have a similar amount of sections as XY table 620, the sections filled with substrates 610*a* and 610*b* where a printer head will print on the substrates 610*a* and 610*b*.

An Auto-loading device may pick up one or a plurality of substrates 610*a* and/or 610*b* from XY table 620 and place one or a plurality of substrates 610*a* and/or 610*b* on printer 220. Auto-loading device may be in communication with control unit 210.

Once substrates 610*a* and/or 610*b* are placed on printer 220, printer 220 may have a device 230 that moves across a surface of substrates 610*a* and/or 610*b* to print.

Auto-offloading device 660 may pick up one or a plurality of substrates 610*a* and/or 610*b* from printer 220 and place one or a plurality of substrates 610*a* and/or 610*b* on table 675. In some examples, auto-offloading device 660 may be configured to reduce the number of piles on table 675 compared to the number of piles of sections of substrates 610 on XY table 620.

Auto-offloading device 660 which may include one or a plurality of vacuum sources 690, may be configured, in some examples, to move with reference to table 675 and printer 220 and lift, move and/or manipulate one or a plurality of substrates 610*a* and/or 610*b*. Substrates 610*a* and/or 610*b* may be lifted off printer 220 by auto-offloading device 660 either concurrently, nearly concurrently or not concurrently. In some examples, auto-offloading device 660 may be able to move in both an X and a Y direction and may be configured to stack substrates 610*a* and/or 610*b* in a number of methodologies.

Auto-offloading device 660 may be in communication with control unit 210. Table 675 may be configured for collating and or collecting printed substrates 610*a* and/or 610*b*. In some examples, substrates 610 may be placed or packed in boxes cartons or other containers for shipping, storage or other purposes.

Figure 7:
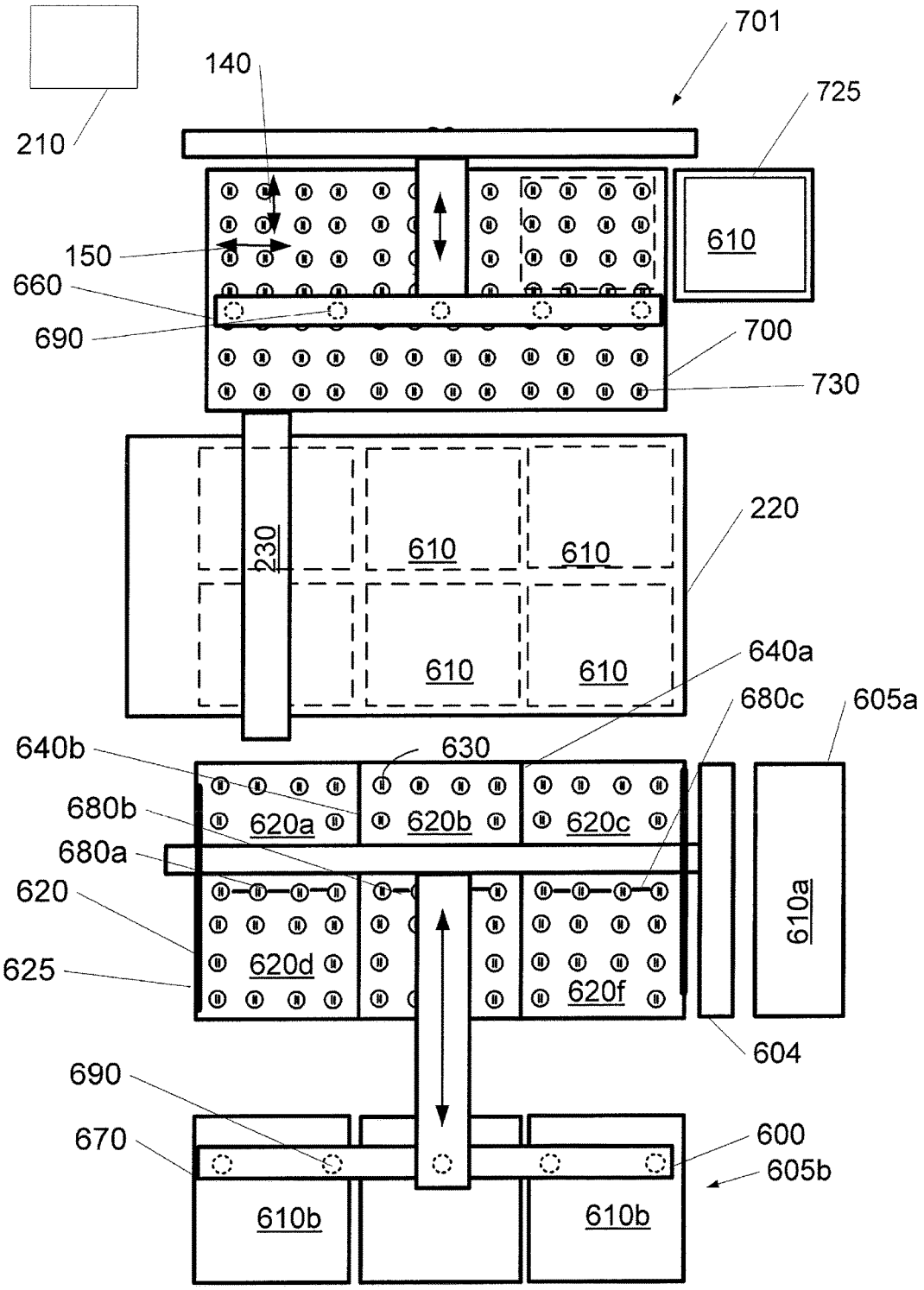
FIG. 7 is an example of a printing system using one or a plurality of XY tables, according to an example.

FIG. 7 is an example of a printing system using one or a plurality of XY tables.

FIG. 7 depicts system 701 for printing on substrates 610; the components thereof may be similar to components described above in similar systems. Substrates 610 may include substrates 610*a* and or 610*b* and/or additional substrates.

In some examples, there may be one or a plurality of substrate sources 605 including but not limited to substrate source 605*a* which may include substrate 610*a* on a roller. A second substrate source 605*b* may include one or a plurality of substrates 610*b*, the one or a plurality of substrates may include stacked substrates in one or a plurality of separate piles on table 670.

In some examples, there may be three separate piles of substrate 610*b* on table 670 for illustrative purposes only. There may be a greater number of piles on table 670 of substrate 610*b*. There may be a smaller number of piles of substrate 610*b*. The piles may include different, similar or identical substrates 610*b*. The substrates 610*a* and 610*b* may differ in one or a plurality of characteristics including size, shape, color texture, rigidity, flexibility or other characteristics- Piles of substrate 610*b* may all reside on a single table 670 or on multiple tables 670. Table 670 may have barriers or dividers to separate the piles of substrate 610*b*.

An auto-loading device 600 may include one or a plurality of vacuum sources 690, and may be configured, in some examples, to move with reference to table 670 and XY table 620 and lift, move and/or manipulate one or a plurality of substrates 610*b*. Vacuum sources 690 may transfer one or a plurality of substrates 610*b* to XY table 620. Table 670 may have one or a plurality of auto-loading devices 600, the auto-loading devices may transfer one or a plurality of substrates 610*b* to XY table 620, in some examples, in the direction of arrow 695, the transfer of substrates 610*b* to XY table 620 may be concurrently or not concurrently.

Auto-loading device 600 may place substrate 610 on XY table 620 in a directed or arbitrary fashion. Auto-loading device may be in communication with control unit 210.

Substrates 610*a* from substrate source 605*a* may also be moved to XY table 620. In some examples, substrate 610*a* may be cut off of a roll where the roll is substrate source 605*a* by an automatic cutting unit 604. In some examples, substrate 610*a* may be cut off of a roll where the roll is substrate source 605*a* by a manual cutting unit. In some examples, substrate 610*a* may be unwound from the roll at a length, and cut to a length and a width by an in-line cutter.

Automatic cutting unit 604 may be configured to cut substrate 610*a* in a first and/or second axis. In some examples, automatic cutting unit 604 may transfer or facilitate the transfer of substrate 610*a* to XY table 620.

In some examples, substrate 610*a* and/or 610*b* may be moved within system 701 as described below with reference to FIG. 8*a* and FIG. 8*b*.

In some examples, XY table 620 may have retractable dividers 640*a* and 640*b* configured to facilitate the registration of one or a plurality of substrates 610*a* and/or 610*b* on XY table 620. In some examples, XY table may have a greater number of dividers. In some examples, XY table 620 may have fewer dividers. XY table 620 may have retractable dividers 680*a*, 680*b* and 680*c*.

In some examples, when all the dividers are unretracted, XY table 620 may be divided into at least 6 sections: 620*a*, 620*b*, 620*c*, 620*d*, 620*e*, and 620*f*, the dividers and the sections configured to register or facilitate the registration of substrates 610. In some examples, two or a plurality of sections 620*a-f* can be combined such that adjacent sections may be combined to make larger sections. In some examples, XY table 620 may be divided into a greater number of sections. In some examples, XY table 620 may be divided into a lesser number of sections.

Each section 620*a-f* may provide an area where one or a plurality of substrates 610*a* and/or 610*b* may be registered. In some examples, one or a plurality of substrates 610*b* from source 605*b* may be moved onto XY table 620 as described above and below with reference to FIG. 8*a* and FIG. 8*b*. In some examples, when substrates 610*b* are moved onto XY table 620 dividers 680*a*, 680*b* and 680*c* are retracted. One or a plurality of substrates 610*b* move along XY table 620 in the directions indicated by arrows 140 and 150 until they reach sections 620*a*, 620*b* and 620*c* respectively of XY table 620. Once one or a plurality of substrates 610*b* reach one or a plurality of sections, dividers 680*a*, 680*b* and 680*c* may become unretracted. Once dividers 680*a*, 680*b* and 680*c* are unretracted one or a plurality of additional substrates 610*b* may be moved onto XY table 610, the one or a plurality of additional substrates 610*b* may move into sections 620*d*, 620*e*, and 620*f* respectively. The movement of substrates 610*b*, and the registration of substrates 610*b* may be facilitated by rollers 630 and or other manipulators, e.g., cylinders and/or wheels- One or a plurality of sides 625 and/or corner pieces of XY table 620 may be configured to facilitate the registration of substrates 610*a* and/or 610*b*-One or a plurality of sides 625 and/or corner pieces of XY table 620 may be retractable, and may be similar to sides 125 described above.

The one or a plurality of substrates in sections 620*a-f* may be registered as described above with reference to FIG. 6. In some examples, only substrates 610*b* from substrate source 605*b* may be moved onto XY table 620 during a print run. In some examples, only substrates from 610*a* from substrate source 605*a* may be moved onto XY table 620 during a print run. In some examples, some sections of XY table 620 may be filled with substrates 610*a* and other sections of XY table 620 may be filled with substrates 610*b* concurrently during a print run.

In some examples, when only substrates from 610*a* from substrate source 605*a* may be moved onto XY table 620 dividers 640*a* and 640*b* and dividers 680*a*, 680*b* and 680*c* may be retracted. Rollers 630 and or additional manipulators may roll substrates into one or a plurality of sections 620*a-f*. Once one or a plurality of substrates 610*a* are in a desired section of sections 620*a-f*, one or a plurality of dividers 640*a* and 640*b* and dividers 680*a*, 680*b* and 680*c* may become unretracted. When one or a plurality of dividers 640*a* and 640*b* and dividers 680*a*, 680*b* and 680*c* may become unretracted, it may facilitate the movement of additional substrates 610*a* and may facilitate the registration of one or a plurality of substrates 610*a* to be registered in one or a plurality of sections 620*a-f*.

Once one or a plurality of substrates 610*a* are registered in one or a plurality of sections 620*a-f*, the one or a plurality of substrates 610*a* may be transferred to printer 620 as described above. In some examples, one or a plurality of dividers 640*a* and 640*b* and dividers 680*a*, 680*b* and 680*c* may need to be retracted before one or a plurality of substrates 610*a* may be transferred to printer 620, in some examples by rollers 630 or, in some examples, as described below with reference to FIG. 8*a* and FIG. 8*b*.

In some examples, one or a plurality of substrates 610*a* and one or a plurality of substrates 610*b* may be moved to XY table 620, during a print run, to be registered concurrently or nearly concurrently as described above. Dividers 640*a* and 640*b* and dividers 680*a*, 680*b* and 680*c* may need to be retracted and unretracted to accommodate the movement and registration of substrates 610*a* and 610*b*.

Rollers 630 may be configured to push substrates 610*a* and/or 610*b* in directions depicted by arrows 140 and 150 until substrates 610*a* and/or 610*b* are registered. In some examples, other means may be used to push substrates 610*a* and/or 610*b* in directions depicted by arrows 140 and 150 until substrates 610*a* and/or 610*b* are registered. In some examples, it may take a longer amount of time for one or a plurality of substrates 610*a* and/or 610*b* to be registered than another one or a plurality of second substrates 610*a* and/or 610*b* after being placed concurrently on XY table 620.

Registered substrates 610*a* and/or 610*b* may be moved concurrently or not concurrently to printer 220. In some examples, rollers 630 may be configured to facilitate the transfer of one or a plurality of substrates 610 from XY table 620 to printer 220, or, in some examples, as described below with reference to FIG. 8*a* and FIG. 8*b*.

In some examples, An Auto-loading device may pick up one or a plurality of substrates 610*a* and/or 610*b* from XY table 620 and place one or a plurality of substrates 610*a* and/or 610*b* on printer 220. Auto-loading device may be in communication with control unit 210. In some examples, substrate 610*a* and/substrate 610*b* may move from XY table 620 to printer 220 via rollers 630.

Once substrates 610*a* and/or 610*b* are placed on printer 220, printer 220 may have a device 230 that moves across a surface of substrates 610*a* and/or 610*b* to print. In some examples, registered substrates 610*a* and/or 610*b* may be moved to another component of system 701. In some examples, registered substrates 610*a* and/or 610*b* may be moved to a component not in system 701.

Auto-offloading device 660 may pick up one or a plurality of substrates 610*a* and/or 610*b* from printer 220 and place one or a plurality of substrates 610*a* and/or 610*b* on an XY table 700. In some examples, auto-offloading device 660 may be configured to reduce the number of piles on XY table 700 compared to the number of piles of sections of substrates 610 on XY table 620. In some examples, one or a plurality of piles may be made by auto-offloading device 660 on XY table 700.

Auto-offloading device 660 which may include one or a plurality of vacuum sources 690, and may in some examples, move with reference to XY table 700 and printer 220 and lift one or a plurality of substrates 610*a* and/or 610*b*. Substrates 610*a* and/or 610*b* may be lifted off printer 220 by auto-offloading device 660 either concurrently or not concurrently. In some examples, auto-offloading device 660 may be able to move in both an X and a Y direction and may be configured to stack substrates 610*a* and/or 610*b* in a number of methodologies, including collating.

Auto-offloading device 660 may be in communication with control unit 210. XY table 700 may be configured for collating and or collecting printed substrates 610*a* and/or 610*b*.

XY table 700 may have one or a plurality of rollers 730 and/or balls and or other manipulators for moving substrates in an X and/or Y direction, as depicted by arrows 705 and 715. In some examples, XY table 700 is configured to be in communication with control unit 210. XY table 700 may move one or a plurality of printed substrates 610*a* and/or substrates 610*b* to another component of a system 701. In some examples, XY table 700 may be configured to move one or a plurality of printed substrates 610*a* and/or substrates 610*b* to another component outside of system 701. Substrate 610, which may include Substrates 610*a* and/or substrates 610*b* may be placed into boxes 752 or cartons for shipping or storage or other purposes by auto-offloading device 660.

Figure 8A:
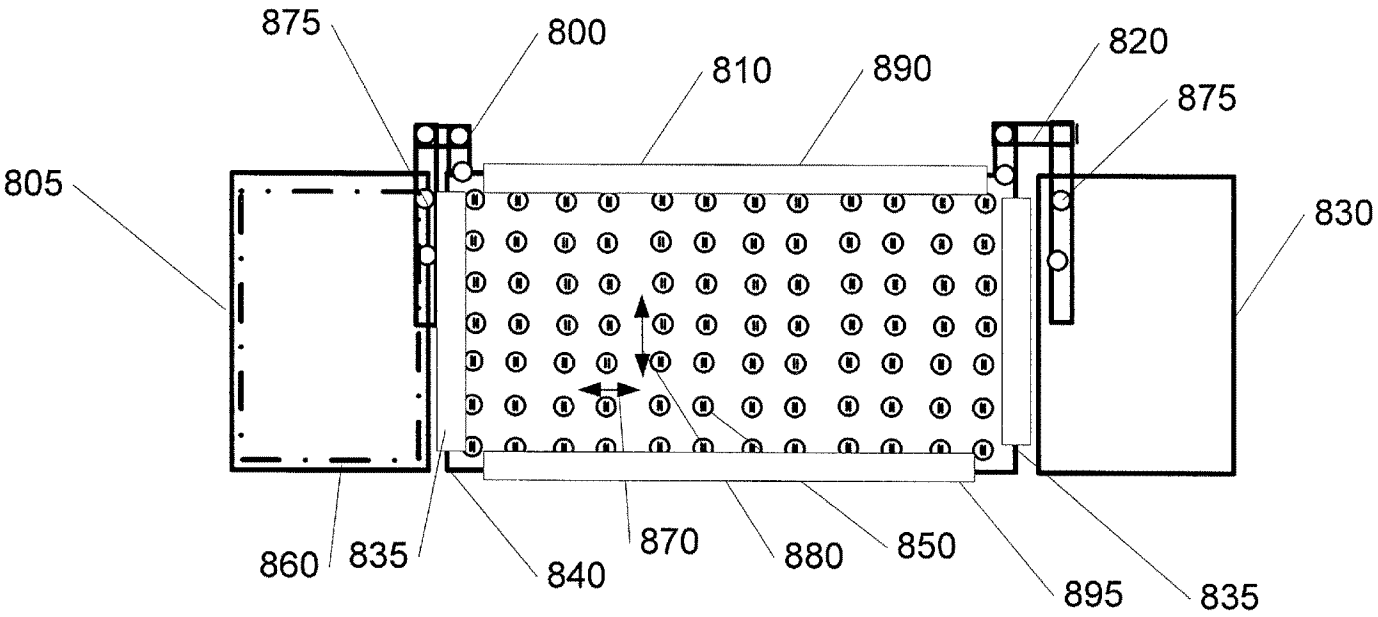
FIG. 8*a* is a schematic illustration of an device that can be used for auto-loading and/or auto-offloading, according to an example.

FIG. 8*a* is a schematic illustration of a device that may be used for auto-loading and/or auto-offloading according to an example.

In some examples, an auto-loading device 800 is configured to be coupled to a XY table 810. In some examples, an auto-offloading device 820 may be coupled to a collecting and/or collating table 830- Auto-offloading device 820 and/or auto-loading device 800 may have one or a plurality of vacuum sources 875. Auto-offloading device 820 and/or auto-loading device 800 may be configured to move a substrate 860 from a first location to a second location, e.g., from a substrate source 805 to XY table 810, or from an XY table 810 to a printer. Substrates source 805 is depicted on one side of XY table 810 for illustrative purposes only; substrate source 805 may be located at one or a plurality of sides of XY table 810.

Auto-loading arm 800 may be coupled to XY table 810 at or near an edge 840 of XY table 810, configured to move substrates a short distance to XY table 810. XY table may have one or a plurality of rollers 850 and or other manipulators as described above with reference to rollers 130 in FIG. 1, the rollers configured to move one or a plurality of substrates 860 along XY table 810 in a direction 870 and/or in a direction 880, as depicted by arrows- In some examples, XY table may have cylinders or other mechanisms to move substrate 860 along XY table 810 in directions 870 and/or 880, as depicted by the arrows. Pinch rollers 835 may be positioned close to edge 840 such that they provide an initial traction for one or a plurality of substrates 860 on XY table 810. In some examples, pinch rollers 835 may be other manipulators configured to transfer substrate 860. In some examples, pinch rollers may be configured to be positioned at or near an edge 890 and an edge 895 of XY table 810 to facilitate the uptake of one or a plurality of substrates 860 onto XY table 810. In some examples pinch rollers 835 may be configured to proved barrier-free access to XY table from substrate sources 805.

Figure 8B:
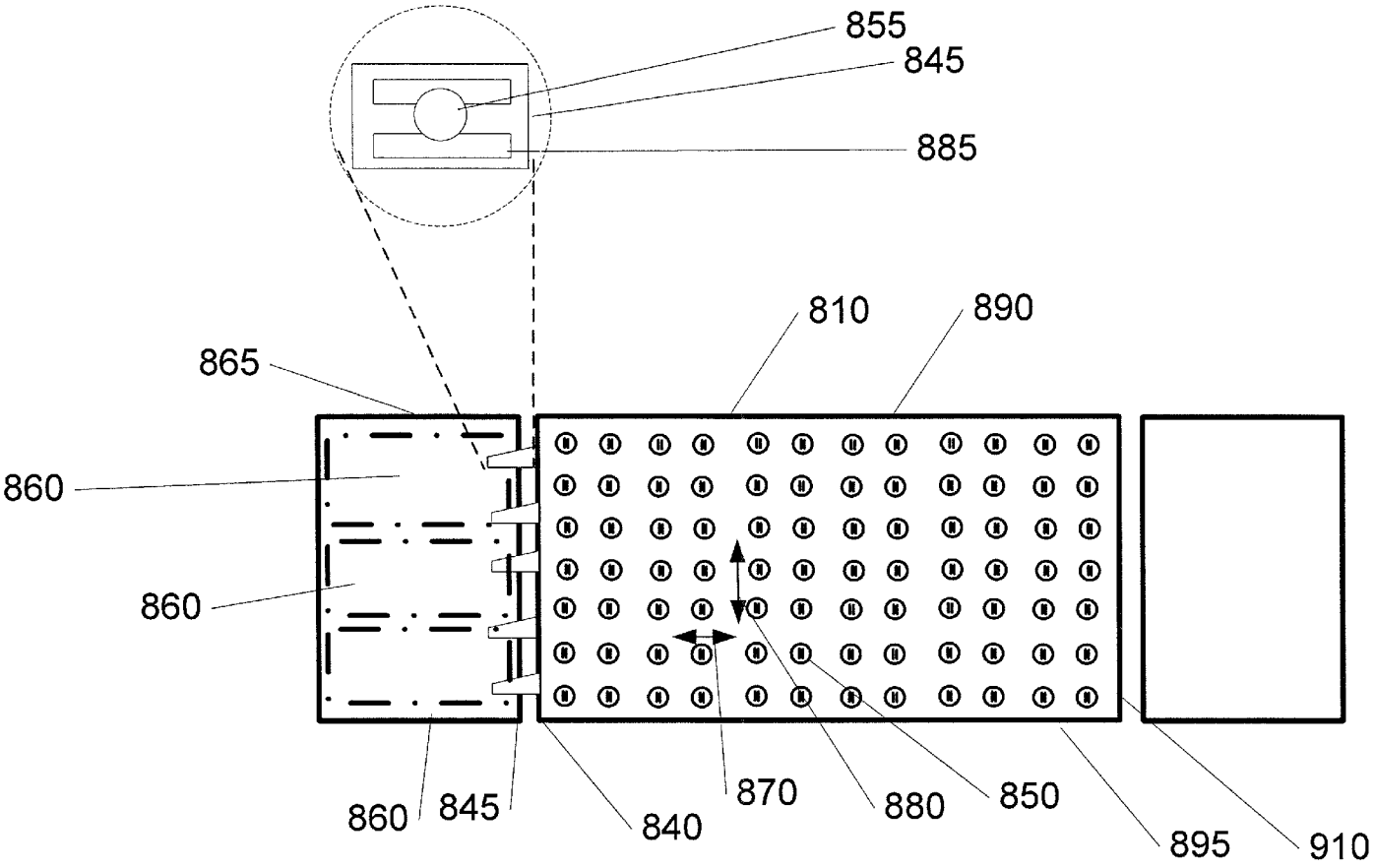
FIG. 8*b* is a schematic illustration of a device that may be used for auto-loading and/or auto-offloading according to an example.

FIG. 8*b* is a schematic illustration of a device that may be used for auto-loading and/or auto-offloading according to an example.

In some examples, one or a plurality of vacuum substrate manipulators 845 may be configured to be coupled to a XY table 810 or to table 865, table 865 configured to hold one or a plurality of substrates 860- In some examples, one or a plurality of vacuum substrate manipulators 845 may be coupled to a collecting and/or collating table 830- The one or a plurality of vacuum substrate manipulators 845 may have one or a plurality of vacuum sources 855, the vacuum sources configured to lift substrates 860. The one or a plurality of vacuum substrate manipulators 845 may have one or a plurality of tracks 885, the tracks configured to move substrates 860. The one or a plurality of vacuum substrate manipulators 845 may be similar to a BDT tornado device produced by BDT Media Automation GmbH.

In some examples, one or a plurality of vacuum substrate manipulators 845 may be configured to move a substrate 860 from a first location to a second location, e.g., from a substrate source 805 to XY table 810, or from an XY table 810 to a printer. Substrates source 805 is depicted on one side of XY table 810 for illustrative purposes only; substrate source 805 and one or a plurality of vacuum substrate manipulators 845 may be located at one or a plurality of sides of XY table 810.

In some examples, one or a plurality of vacuum substrate manipulators 845 may be located at or near an edge 840 of XY table 810, configured to move substrates a short distance to XY table 810. XY table may have one or a plurality of rollers 850 and or other manipulators as described above with reference to rollers 130 in FIG. 1, the rollers configured to move one or a plurality of substrates 860 along XY table 810 in a direction 870 and/or in a direction 880, as depicted by arrows- In some examples, XY table may have cylinders or other mechanisms to move substrate 860 along XY table 810 in directions 870 and/or 880, as depicted by the arrows. In some examples one or a plurality of vacuum substrate manipulators 845 may be configured to proved barrier-free access to XY table from substrate sources 805.

Figure 9:
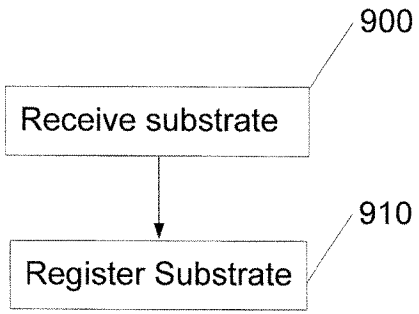
FIG. 9 is a schematic illustration of a method, according to an example; and, FIG. 10 is a schematic illustration of a system, according to an example.

FIG. 9 is a schematic illustration of a method according to an example.

In some examples, a method for receiving and submitting a substrate 110, may include configuring an XY table to accept a substrate as depicted in box 900- The XY table may have one or a plurality of sides for accepting the substrate. Box 910 depicts configuring a set of manipulators to accept and register the substrate from one or a plurality of sides of the XY table. The registration may be in advance of submitting the substrate to be modified by a printer, e.g., to be printed upon.

Figure 10:
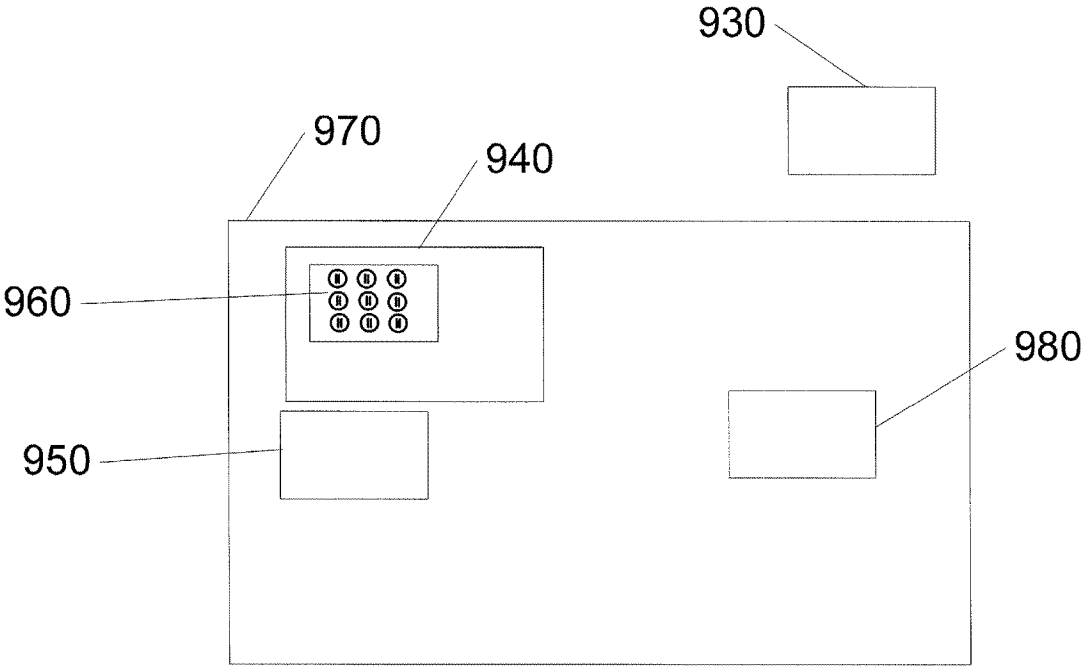

FIG. 10 is a schematic illustration of a system according to an example.

In some examples, a system 970 for receiving and submitting a substrate 930 may include an XY table 940, the XY table having one or a plurality of sides for accepting one or a plurality substrates 930, e.g., a paper or other printing surface to be modified by a printer 950. The XY table may include a set of manipulators 960 coupled to XY table 940, the manipulators configured to accept and register one or a plurality of substrates 930 from the one or plurality of sides of the XY table. The system may be controlled by a control unit 980.

Examples may include apparatuses for performing the operations described herein. Such apparatuses may be specially constructed for the desired purposes, or may comprise computers or processors selectively activated or reconfigured by a computer program stored in the computers. Such computer programs may be stored in a computer-readable or processor-readable non-transitory storage medium, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions. It will be appreciated that a variety of programming languages may be used to implement the teachings of the examples as described herein. Examples may include an article such as a non-transitory computer or processor readable non-transitory storage medium, such as for example, a memory, a disk drive, or a USB flash memory encoding, including or storing instructions, e.g., computer-executable instructions, which when executed by a processor or controller, cause the processor or controller to carry out methods disclosed herein. The instructions may cause the processor or controller to execute processes that carry out methods disclosed herein.

Different examples are disclosed herein. Features of certain examples may be combined with features of other examples; thus, certain examples may be combinations of features of multiple examples. The foregoing description of the examples has been presented for the purposes of illustration and description. It is not intended to be exhaustive or to limit the examples to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the examples.

What is claimed is:

1. A device comprising:

a first substrate source comprising a roll of substrate and a cutter to cut the roll of substrate into individual cut substrates;

a second substrate source comprising individual precut substrates;

an XY table to receive a cut substrate from the first substrate source and a precut substrate from the second substrate source;

a plurality of rollers located on a surface of the XY table to adjust the cut and precut substrates on the XY table for alignment for printing and to move the cut and precut substrates from the XY table to a printer after the cut and precut substrates have been registered; and a set of retractable dividers on the XY table to register the cut and precut substrates.

2. The device of claim 1, further comprising an auto-loading device to move the cut substrate from the first substrate source to the XY table.

3. The device of claim 1, further comprising a second XY table collect the cut and precut substrates after the cut and precut substrates are printed on by the printer.

4. The device of claim 3, wherein the second substrate source comprises a plurality of stacks of individual precut substrates and the device further comprises a loading device to concurrently load a plurality of precut substrates onto the XY table.

5. The device of claim 1, wherein the first substrate source includes a plurality of vacuum substrate manipulators to transfer the cut substrate to the XY table.

6. The device of claim 1, further comprising one or a plurality of pinch rollers located at an edge of the XY table to provide an initial traction to enable transfer of the cut substrate from the first substrate source onto the XY table.

7. A system for receiving and submitting substrates, the system comprising:

a first substrate source comprising a roll of substrate and a cutter to cut the roll of substrate into individual cut substrates;

a second substrate source comprising a stack of individual precut substrates;

an XY table having a first side to accept a cut substrate from the first substrate source and a second side to accept a precut substrate from the second substrate source;

a plurality of rollers located on a surface of the XY table to adjust the cut and precut substrates on the XY table for alignment for printing and to move the cut and precut substrates from the XY table to a printer after the cut and precut substrates have been registered; and a set of retractable dividers on the XY table to register the cut substrate and the precut substrate.

8. The system of claim 7, wherein the second substrate source comprises a plurality of stacks of individual precut substrates and a loading device to concurrently load a plurality of precut substrates onto the XY table.

9. The system of claim 7, wherein the system further comprises pinch rollers to move the cut substrate from the first substrate source to the XY table.

10. The system of claim 7, further comprising a second XY table to collect and collate the cut and precut substrates after the cut and precut substrates have been printed on by the printer.

* * * * *